US009863082B1

(12) United States Patent
Ayers et al.

(10) Patent No.: US 9,863,082 B1
(45) Date of Patent: Jan. 9, 2018

(54) DISPENSER CUP

(71) Applicant: WHIRLPOOL CORPORATION, Benton Harbor, MI (US)

(72) Inventors: Kevin Ayers, Saint Joseph, MI (US); Seth Bixby, Stevensville, MI (US); Sayer J. Murphy, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/253,128

(22) Filed: Aug. 31, 2016

(51) Int. Cl.
*D06F 35/00* (2006.01)
*D06F 39/02* (2006.01)

(52) U.S. Cl.
CPC ..... *D06F 39/02* (2013.01); *D06F 35/006* (2013.01); *D06F 39/022* (2013.01)

(58) Field of Classification Search
CPC ..... D06F 35/006; D06F 39/02; D06F 39/022
USPC ..... 68/17 R
See application file for complete search history.

(56) References Cited

U.S. PATENT DOCUMENTS 6,401,499 B1 6/2002 Clark et al.
2013/0327101 A1* 12/2013 Leibman ..... D06F 71/10 68/17 R

* cited by examiner

*Primary Examiner* — Levon J Shahinian

(57) ABSTRACT

A washing machine includes a cabinet defining a housing with internal components of a conventional automated clothes washer, a door mounted to the cabinet to selectively open/close the opening to the cabinet, and a dispenser in the form of a fill cup assembly in which single or bulk doses of treating chemistry can be received. The fill cup assembly includes a base cup with at least first and second fluid conduits supplying corresponding destinations, and a selector cup defining a pour zone. The selector cup includes an outlet and rotatable relative to the base cup to selectively fluid couple the outlet to the at least first and second fluid conduits.

15 Claims, 4 Drawing Sheets

DISPENSER CUP

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, the dispenser is in the form of a cup mounted on the surface of the cabinet. Such dispensers typically have at least one cup that defines a pour zone for a specific treating chemistry or dispensing functions such as a single use or bulk dispenser. It will be desirable for a washing machine to use minimal surface space as pour zones for various types of treating chemistry and dispensing functions.

BRIEF SUMMARY

In one aspect, embodiments of the current disclosure relate to a laundry treating appliance having a cabinet defining an interior and having an access opening providing access to the interior. A treating chamber is located within the interior. The cabinet carries a treating chemistry dispenser fluidly coupled to the treating chamber. A treating chemistry fill cup assembly has a base cup with first and second fluid conduits supplying corresponding first and second destinations, and a selector cup having an outlet and movable relative to the base cup to selectively fluid couple the outlet to the first and second fluid conduits.

In another aspect, embodiments of the current disclosure relate to a method of supplying treating chemistry to at least two different destinations in a laundry treating appliance. The method includes selectively fluidly coupling a common dispensing cup to first and second conduits that are correspondingly fluidly coupled to the first and second destinations.

DETAILED DESCRIPTION

Figure 1:
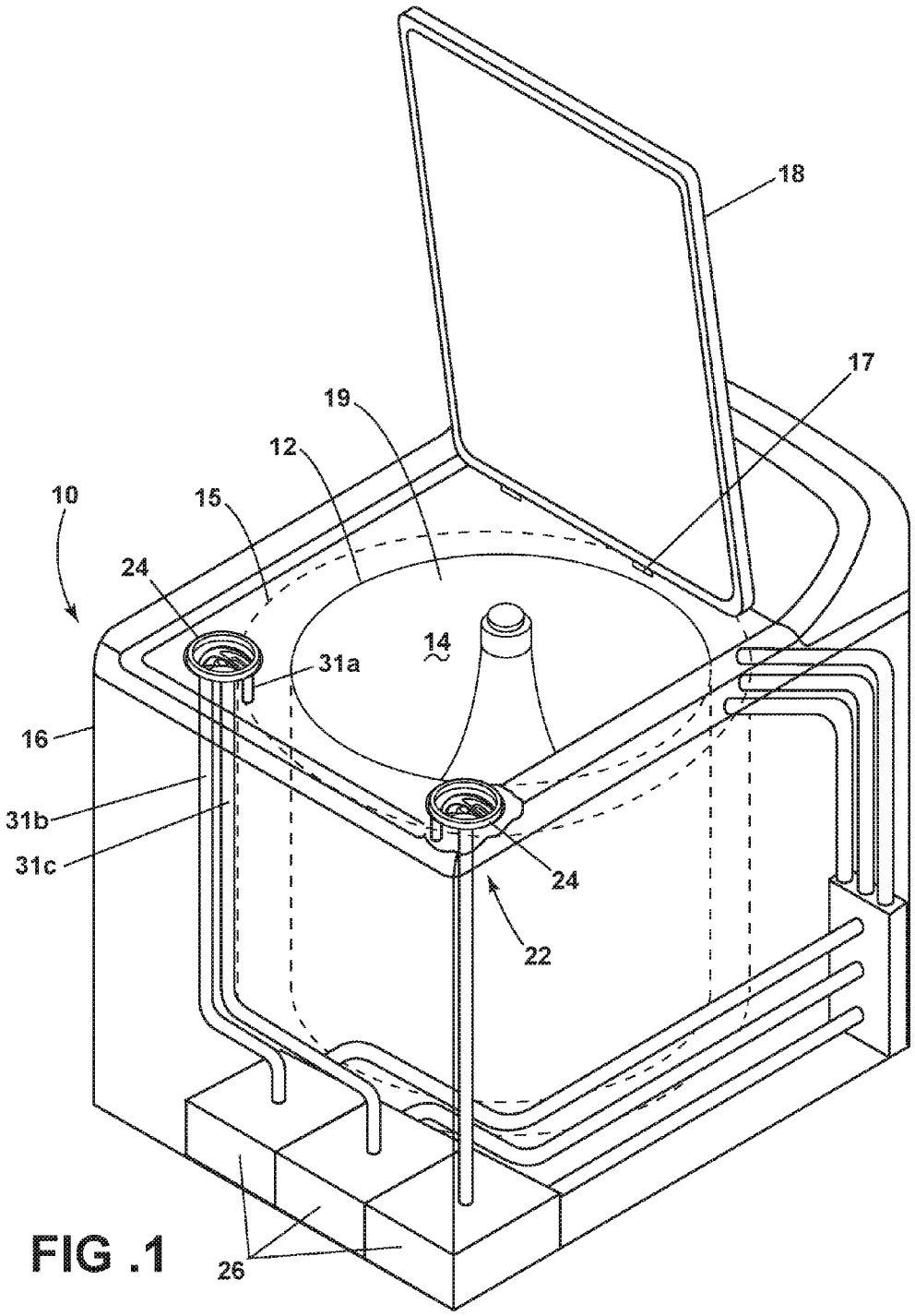
FIG. 1 is a front view of a laundry treating appliance in the form of an automatic washing machine having a cabinet with a door shown in an opened condition, and with a dispenser assembly.

Referring now to FIG. 1, a first embodiment in accordance with the present disclosure is illustrated as a laundry treating appliance in the environment of a vertical axis automatic clothes washing machine 10. Although much of the remainder of this application will focus on the embodiment of an automatic clothes washing machine, the illustrative embodiments have utility in other environments, including other laundry treating appliances or other top loading appliances with a single use or bulk dispenser. Depending on the configuration, it is possible for the embodiments to have applicability in horizontal axis washing machines and other front loading appliance.

The washing machine 10 shares many features of a conventional automated clothes washer, which will not be described in detail herein except as necessary for a complete understanding of the illustrative embodiments in accordance with the present disclosure. The washing machine 10 has a rotatable drum 12 that defines a treating chamber 14 for receiving the laundry and rotates about a generally vertical axis.

A tub 15 receives the drum 12 and holds liquid for use in a treating cycle of operation. The tub 15 can rotatably mount the drum 12. The tub 15 can be associated with a sump for holding a liquid used during a cleaning cycle. The sump can be normally connected to a drain (not shown) to provide a flow path for removing the liquids.

A cabinet 16 can define a housing within which a suspension system (not shown) is provided for suspending the tub 15 within the cabinet 16. The cabinet 16 can be a housing having a chassis and/or a frame to which panels are mounted to define an interior, enclosing components typically found in a conventional washing machine, such as motors, pumps, fluid lines, controls, sensors, transducers, and the like. Such components will not be described further herein except as necessary for a complete understanding of the disclosure.

A closure in the form of a door 18 is mounted to the cabinet 16 via a hinge 17. The door 18 can be rotated about the hinge 17 to selectively close an opening 19 to the treating chamber 14. Both the tub 15 and a drum 12 can be located within the interior of the cabinet 16.

The washing machine 10 can also be provided with a dispenser assembly 22 for dispensing treating chemistry to the treating chamber 14 for use in treating the laundry according to a cycle of operation. The dispenser assembly 22 is illustrated to include an integrated single use and bulk dispensing system.

The dispenser assembly 22 includes at least one treating chemistry fill cup assembly 24 and at least one bulk reservoir 26. The fill cup assembly 24 is mounted to the cabinet 16 in one of the corners of the surface surrounding the access opening 19 to the treating chamber 14. The fill cup assembly 24 can be rotated to selectively direct treating chemistry into the treating chamber 14 for a single use application or storage in the associated bulk reservoir 26 for bulk dispensing application. As shown in the illustration, the fill cup assembly 24 can be configured to direct treating chemistry to more than two destinations. For instance, fluid can be directed to the treating chamber 14 via fluid conduit 31*a* and to multiple bulk reservoirs 26 via fluid conduit 31*b* and 31*c*. These reservoirs 26 are used for containing various treating chemistries, such as but not limited to liquid detergent, bleach, and fabric softener. These reservoirs 26 can be located interiorly or exteriorly of the cabinet 16.

Figure 2:
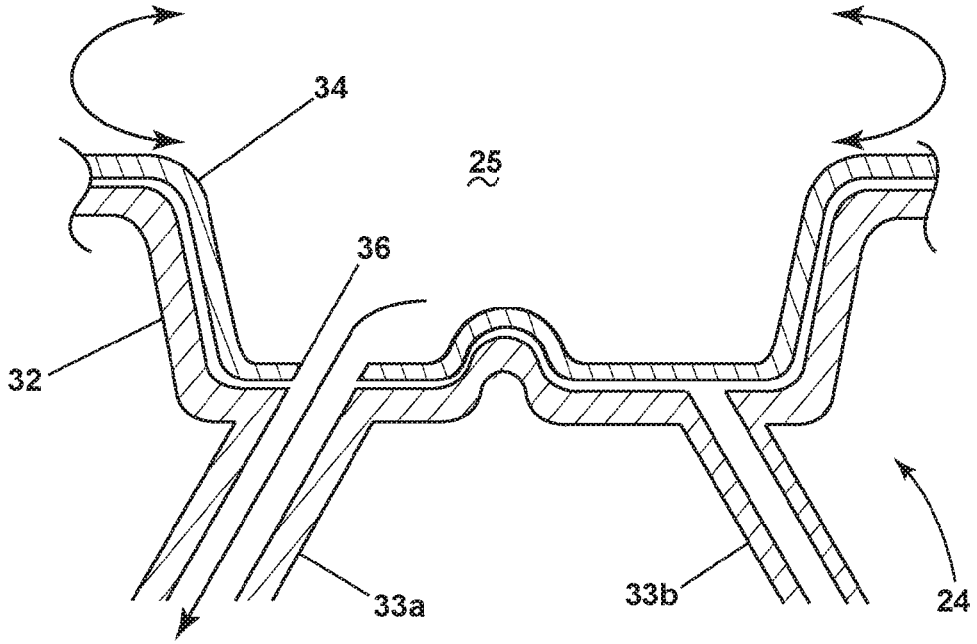
FIG. 2 is a schematic view of a treating chemistry fill cup assembly.

Referring to the schematic diagram of FIG. 2, the fill cup assembly 24 comprises a base cup 32 with at least first and second fluid conduits 33*a,b* supplying corresponding destinations, and a selector cup 34 defining a pour zone 25. The selector cup 34 includes an outlet 36 and rotatable relative to the base cup 32 to selectively fluidly couple the outlet 36 to the at least first and second fluid conduits 33*a,b*. As shown in the figure, the first fluid conduit 33*a* can be directed to the associated first destination and the second fluid conduit 33*b* can be directed to the second destination. By aligning the outlet 36 of the selector cup 34 to the fluid conduit 33*a* of the base cup 32, a single passage for the flow of fluid through fluid conduit 33*a* is created while passage to fluid conduit

33*b* is closed. Treating chemistry poured into the selector cup 34 can be directed exclusively to the first destination. Alternatively, the selector cup 34 can be rotated clockwise or anti-clockwise to selectively align the outlet 36 to create a passage for fluid to flow through the fluid conduit 33*b* into the second destination.

Figure 3:
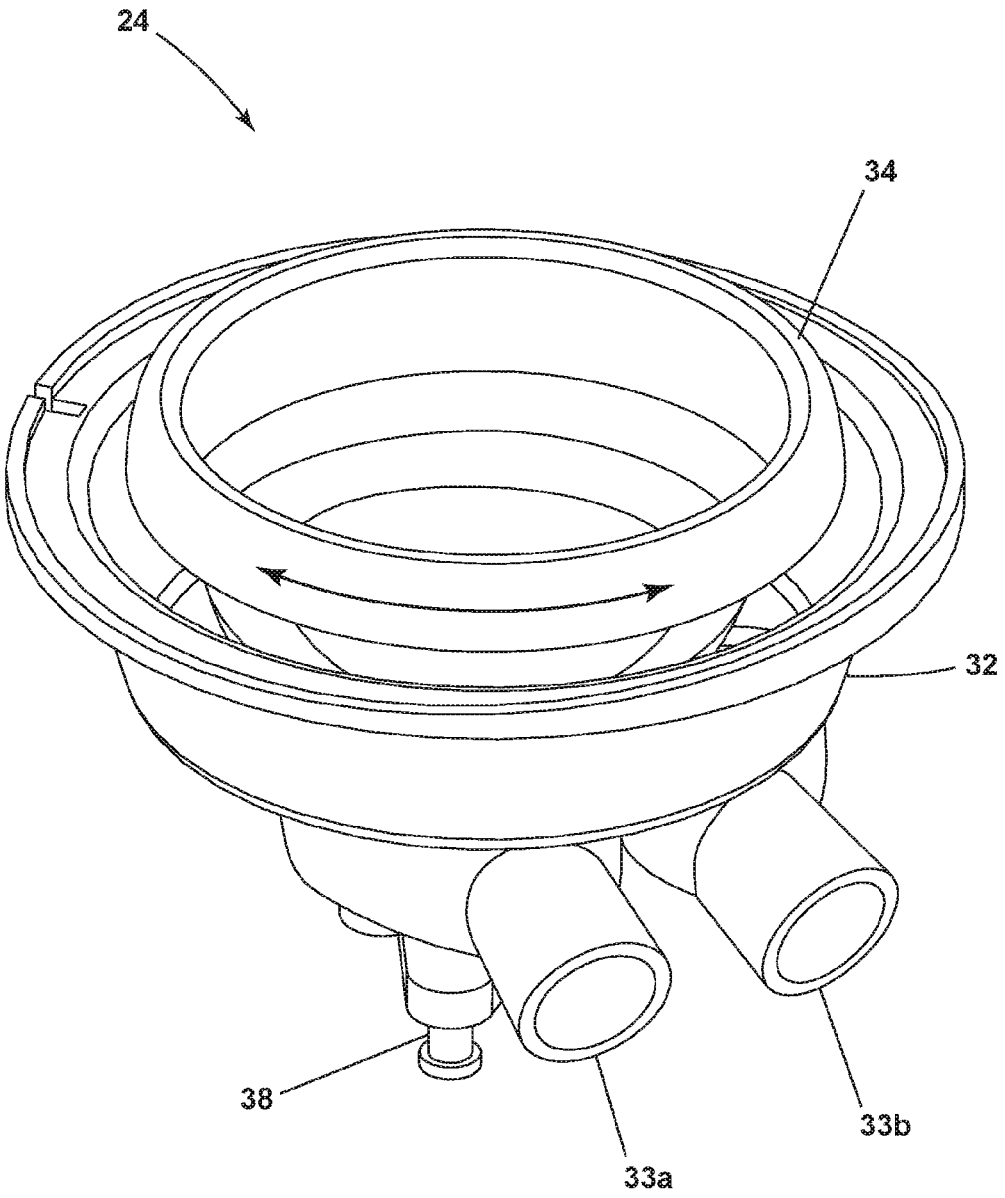
FIG. 3 is a perspective view of the treating chemistry fill cup assembly.
Figure 4:
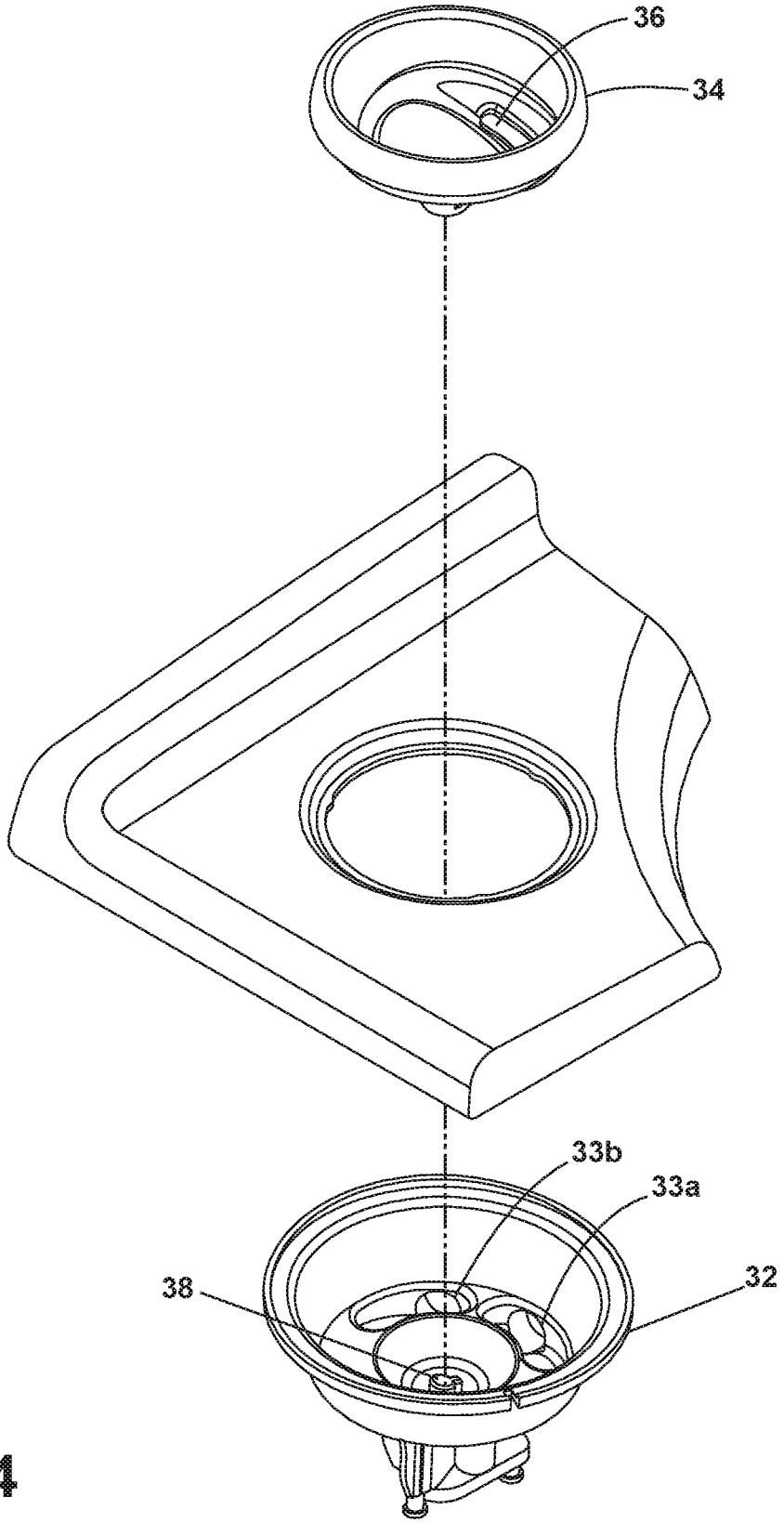
FIG. 4 is an exploded, perspective view of the treating chemistry fill cup assembly of FIG. 3.

Referring to FIGS. 3 and 4, the selector cup 34 and base cup 32 have complementary shapes wherein the selector cup 34 is at least partially received within the base cup 32. A rotatable shaft 38 with over-the-center spring mechanism passes through the base cup 32 and is rotatable by the selector cup 34. The rotatable shaft 38 with over-the-center spring mechanism biases the base cup 32 and selector cup 34 towards one another and act as a detent mechanism between the base cup 32 and selector cup 34 to divide the rotation into specific increments. As shown in FIG. 4, the specific increments can be configured to align the outlet 36 of the selector cup 34 to each fluid conduits 33*a,b* of the base cup 32. The specific increments can also be configured to align the outlet 36 to a sealed region of the base cup 32 to create a closing position without having a separate lid.

The fill cup assembly 24 utilizes a single pour zone 25 to direct treating chemistries to multiple destinations. This feature improves the ease of use and maintains aesthetic value with a clean surface finish surrounding the access opening 19 to the treating chamber 14. Furthermore, it will not be necessary to decrease the size of the access opening 19 of the treating chamber 14 due to having multiple pour zones for various chemistries and dispensing function.

Although the embodiment of the present invention have been shown and described, it would be appreciated by those skilled in the art that changes may be made in these embodiments without departing from the principles and spirit of the invention, the scope of which is defined in the claims and their equivalents.

The invention claimed is:

1. A laundry treating appliance comprising:

a cabinet defining an interior and having an access opening providing access to the interior;

a treating chamber located within the interior;

a treating chemistry dispenser carried by the cabinet and fluidly coupled to the treating chamber; and a treating chemistry fill cup assembly having:

a base cup with at least first and second fluid conduits supplying corresponding first and second destinations; and a selector cup having an outlet and a shape such that the selector cup is at least partially receivable within the base cup and moveable relative to the base cup;

wherein the selector cup is moveable relative to the base cup to a first position in which the outlet is aligned with the first fluid conduit and a second position in which the outlet is aligned with the second fluid conduit.

2. The laundry treating appliance of claim 1, wherein the treating chemistry fill cup assembly functions as cup for the treating chemistry dispenser.

3. The laundry treating appliance of claim 2 wherein the first destination is the treating chemistry dispenser.

4. The laundry treating appliance of claim 3 further comprising a bulk reservoir and the second destination is the bulk reservoir.

5. The laundry treating appliance of claim 1 further comprising at least one bulk reservoir and the first destination is one of the treating chemistry dispenser, the treating chamber, or the at least one bulk reservoir.

6. The laundry treating appliance of claim 5 wherein the second destination is another of the treating chemistry dispenser, the treating chamber, or the at least one bulk reservoir.

7. The laundry treating appliance of claim 6 wherein the at least one bulk reservoir comprises at least two bulk reservoirs and the first destination is one of the at least two bulk reservoirs and the second destination is another of the at least two bulk reservoirs.

8. The laundry treating appliance of claim 5 wherein the at least one bulk reservoir is located exteriorly of the cabinet.

9. The laundry treating appliance of claim 5 wherein the at least one bulk reservoir is located interiorly of the cabinet.

10. The laundry treating appliance of claim 1 wherein the selector cup and the base cup have complementary shapes.

11. The laundry treating appliance of claim 1 wherein the treating chemistry fill cup assembly is mounted to the cabinet.

12. The laundry treating appliance of claim 2 wherein the cabinet defines a surface surrounding the access opening and the treating chemistry fill cup assembly is provided in the surface.

13. The laundry treating appliance of claim 12 wherein the surface defines at least one corner and the treating chemistry fill cup assembly is located in the at least one corner.

14. The laundry treating appliance of claim 12 wherein the surface is a horizontal surface.

15. The laundry treating appliance of claim 1 further comprising a tub and a basket received within the tub, with at least one of the tub and the basket defining the treating chamber.

* * * * *